United States Patent [19]

Carreiro

[11] 4,190,988

[45] Mar. 4, 1980

[54] METHOD, SYSTEM AND COMPONENTS FOR PRESERVING WOODEN GUTTERS

[76] Inventor: Ronald Carreiro, 105 Stratford St., W. Roxbury, Mass. 02132

[21] Appl. No.: 867,030

[22] Filed: Jan. 5, 1978

[51] Int. Cl.[2] ..... E04D 13/00

[52] U.S. Cl. ..... 52/16; 52/11

[58] Field of Search ..... 52/11–15, 52/16; 61/14; 405/119

[56] References Cited

U.S. PATENT DOCUMENTS

| | | | |
|---|---|---|---|
| 217,002 | 7/1879 | Decrow | 52/11 |
| 223,671 | 1/1880 | Fugate | 52/11 |
| 280,737 | 7/1883 | Gould | 52/16 |
| 857,601 | 6/1907 | Cooper | 52/13 |
| 2,210,248 | 8/1940 | Lighthill | 52/16 |
| 2,258,070 | 10/1941 | Tennison | 52/13 |
| 3,545,144 | 12/1970 | Sickler | 52/11 |
| 3,611,731 | 10/1971 | Edmondson | 61/14 |

*Primary Examiner*—John E. Murtagh

*Attorney, Agent, or Firm*—Morse, Altman, Oates & Bello

[57] ABSTRACT

Wooden gutters are protected against the weather and their useful life extended by applying a flexible plastic liner along the trough of the gutter and closing the ends thereof with sealing caps. The liners and caps are tightly secured in place to prevent water from seeping in-between the liner and the wood gutter. The liner is of extruded, flexible plastic material contoured to fit snuggly within the gutter trough and is readily cut to a length corresponding to the length of the gutter. The end caps may be made of injection molded plastic parts formed with cooperating grooves to receive the ends of the liner, and connectors are provided to join adjacent sections of liners. Other components include corner joints, drain connectors and lifters to provide a pitch to the liner to ensure drainage.

14 Claims, 9 Drawing Figures

FIG. 1
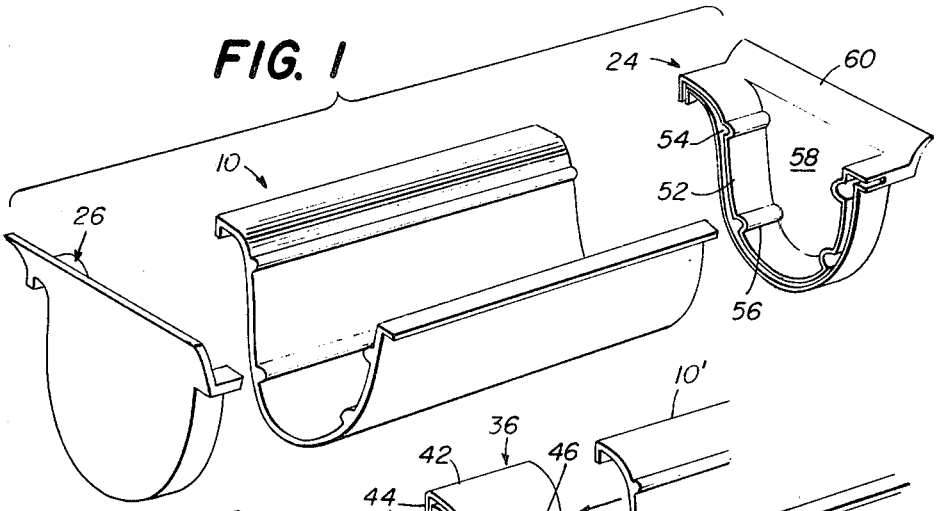
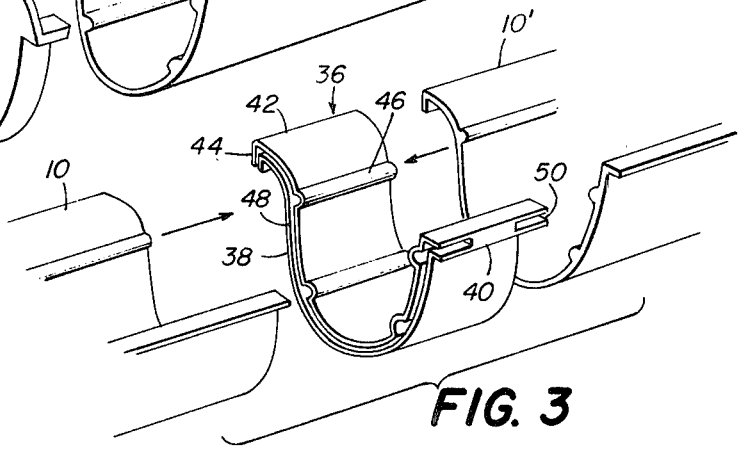
FIG. 3
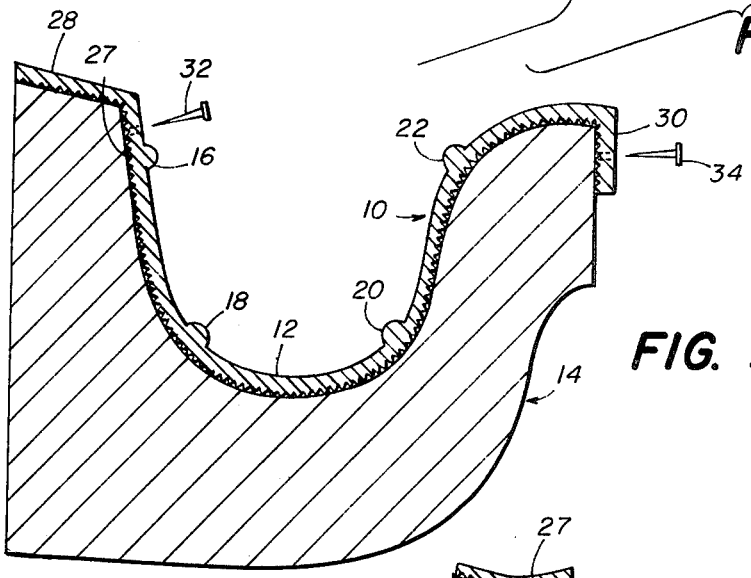
FIG. 2
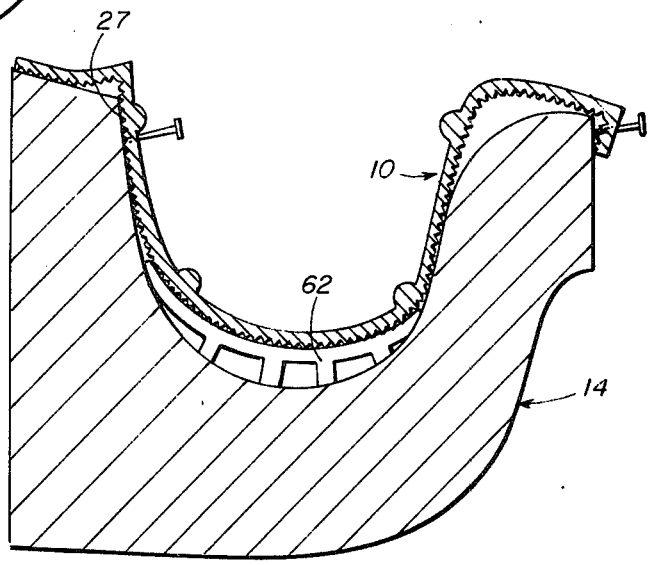
FIG. 5

METHOD, SYSTEM AND COMPONENTS FOR PRESERVING WOODEN GUTTERS

BACKGROUND OF THE INVENTION

1. Field of the Invention

This invention relates generally to methods, systems and components for lining wooden gutters and more particularly is directed towards a new and improved method and associated components for weatherproofing wooden gutters, both new and old, to extend the life thereof.

2. Description of the Prior Art

Most older homes and many new homes have wooden gutters along their eaves to channel rain and melting snow running from the roof into a downspout. To insure a reasonable life span wooden gutters must be periodically cleaned and scraped to remove accumulated debris and then coated with linseed oil, or the like, to prevent rotting. The troughs of the gutters normally are unpainted and tend to rot rather quickly because of repeated soaking from rain and the drying of the sun. Once the gutters start to rot there is little that can be done apart from the application of temporary patching with tar-like materials. In general, once rotting starts to take place, the gutters must be replaced either with similar wooden gutters or gutters made from other materials, such as aluminum or rigid plastic.

Insofar as the annual treatment of gutters with linseed oil is a somewhat difficult and dangerous task, it is often ignored by many home owners. As a result, such gutters deteriorate more rapidly than would be the case if they had been properly maintained. Total replacement of the gutters becomes necessary with attendant heavy expenses for parts and labor. Conventional repairs to rotted gutters are generally not particularly practical and normally serve only as a temporary measure.

It is an object of the present invention to provide a novel method and associated components for covering wooden gutters with a flexible plastic liner to greatly extend the life of the gutter whether new or old. Another object of this invention is to provide a method and associated components for lining wooden gutters which may be done quickly and easily by the home owner and which, once done, greatly reduces the maintenance requirements for the gutters. A further object of this invention is to provide a simple, low-cost method and associated system components for weatherproofing wooden gutters.

SUMMARY OF THE INVENTION

This invention features the method of preserving the trough of a wooden gutter comprising the steps of installing a flexible plastic liner over the exposed surfaces of the trough and securing the liner in place.

This invention also features a liner system for weatherproofing the troughs of wooden gutters comprising a length of flexible, imperforate plastic material generally contoured in cross-section to conform to the cross-sectional shape of the trough and adapted to fully line the trough when installed therein. The system also inclues preformed end caps adapted to seal against the ends of the liner, connectors for joining liner sections in end-to-end relation, lifters for providing a proper pitch to the liner, corner joints and downspout connectors.

BRIEF DESCRIPTION OF THE DRAWINGS

FIG. 1 is an exploded view in perspective showing a section of gutter liner and end cap made according to the invention, FIG. 2 is a sectional view in side elevation showing a gutter with a liner in place, FIG. 3 is a view similar to FIG. 1 showing a connector for a pair of liner sections, FIG. 5 is a sectional view in side elevation showing a lifter in place beneath a liner installed in a gutter.

DETAILED DESCRIPTION OF THE PREFERRED EMBODIMENTS

Figure 6:
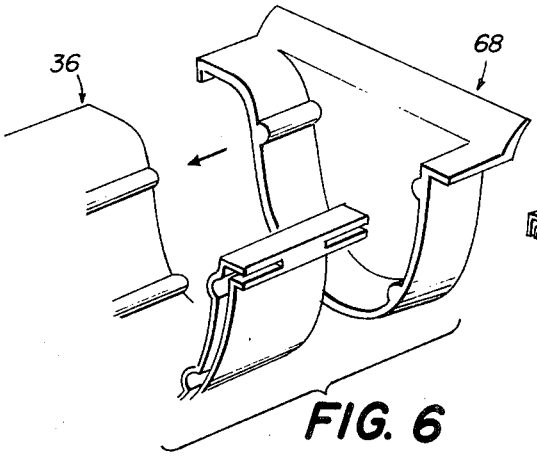
FIG. 6 is an exploded view in perspective showing a modification of the invention.

Referring now to the drawings, and to FIGS. 1 and 2 in particular, the reference character 10 generally indicates a flexible plastic liner for installation in a trough 12 of a wooden gutter 14. The liner 10, in the preferred embodiment, is of a relatively soft, thin, flexible plastic material which may be conveniently formed by extruding techniques from materials such as ABS, polyethylene, polyporpolene, flexible PVC or the like. While the material may be provided in colors, clear plastic is satisfactory. Flexible ABS is available in a wide range of thicknesses, from 0.010" to ⅛"; however, for present purposes a liner thickness in the range of 0.020 to 0.025" is preferred. Such a thickness provides a satisfactory balance of strength, toughness, durability and flexibility coupled with lightness in weight and is easily conformed to the contours of the gutter trough. ABS, in this thickness, is very tough and displays desirable long-wearing characteristics.

In the illustrated embodiment, the liner 10 is formed with a plurality of longitudinally spaced parallel ribs 16, 18, 20 and 22 along the upper inner face thereof. The integral ribs serve several functions, including the provision of a gripping surface for the installer in adjusting the liner with respect to the trough to ensure a proper fit. The ribs serve as guides and also to prevent skewing of the liner by locking the liner to female end caps 24 and 26. The ribs also help to control the flow of rain water, guiding the water along the trough and inhibiting the water against splashing over the sides of the gutter. The lower face preferably is formed with longitudinal corrugations 27 which enhance the bond between the liner and gutter when an adhesive such as epoxy is used to secure the liner in place.

The liner is also formed with a rearwardly extending longitudinal lip 28 adapted to overlay the rear upper edge of the gutter and thus prevent rain water from seeping between the liner and the trough at the back of the gutter. The liner is generally U-shaped in cross-section to conform with the standard cross-sectional profile of the gutter trough and is formed with an outwardly curving outer edge terminating in a downwardly extending longitudinal flange or lip 30 which is adapted to extend over and down the forward upper edge of the trough, as best shown in FIG. 2. This provides sealing along the outer edge of the liner to prevent rain or moisture from seeping in-between the liner and gutter at the exposed outer portion.

The liner may be fixed in position by various means, such as staples or nails 32 and 34 which may be driven in along the front face of the gutter at the flange 30 and near the back edge thereof as shown. Preferably, the nails should be of copper or brass to prevent rusting. Galvanized steel or aluminum may also be used. Other means may also be used to secure the liner permanently in place. For example, various types of adhesives may be employed to cement the liner to the gutter trough. Such adhesives should be compatible with the plastic as well as the wood to ensure a watertight, permanent bond throughout. Various types of resinous adhesives are suitable for this purpose. Such adhesives may be applied over the gutter trough with a brush, for example, and then the liner installed. Alternatively, the liner may be provided with a layer of pressure-sensitive adhesive on its inner face and would be self-sealing when installed. In such an event, it would be necessary to furnish a release sheet over the pressure-sensitive adhesive, which sheet would be peeled away prior to installing the liner. Other adhesives may also be used to advantage.

The liner may be extruded in almost any length and, in practice, may be provided in continuous lengths of 50′ to 100′, for example, or longer, and because of the inherent flexibility of a liner, it may be rolled into a coil and sold according to the length required by the customer. The seller merely measures off the required length, cutting a measured length from the coil. Typically, the customer purchases a length of liner sufficient to extend at least the full reach of the gutter to be lined and, in practice, should purchase slightly in excess of that length to ensure that the liner will extend the full length of the gutter in a single, continuous piece. If, in installing the liner, it is too long, the extra length may be readily trimmed off by means of a scissors or knife.

In the event that a length of liner is too short for a particular section of gutter, two liner sections may be joined by means of a connector 36, as illustrated in FIG. 3. The connector 36 preferably is a molded plastic part of generally U-shaped cross-section conforming to the profile of the gutter trough. The connector is somewhat thicker than the liner 10 and typically would be somewhat more rigid because of the added thickness. The connector is relatively short and may be only 1″ or so in length. The cross-sectional shape of the connector is similar to that of the liner and includes a U-shaped center portion 38, a rearwardly-facing rear upper lip 40, and a forwardly-facing upper forward lip 42 terminating in a downwardly-extending flange 44. Ribs 46 are also provided in the inner wall of the connector in alignment with the ribs on the liner. Both side edges of the connector are formed with recesses 48 and 50 extending from front to rear of the connector and adapted to slidably receive opposing ends of liner sections 10 and 10′, as suggested in FIG. 3.

When the liner sections are joined by the connector, a snug fit is provided to make a continuous section of liner within the gutter. In practice, watertight integrity may be insured by utilizing an appropriate adhesive or sealant between the connector and the liner sections. Various types of epoxies, such as methyl ethyl ketone, for example, would produce a satisfactory, durable watertight seal between the joints. Numerous other bonding agents may also be utilized.

Once the gutter liner of one or more pieces has been fitted to the gutter, the end caps 24 and 26 are installed at opposite ends of the gutter in order to seal the ends of the liner, thereby completely sealing the wooden gutter from end-to-end. The end caps 24 and 26 are of matching but opposite configurations in order to provide right-hand and left-hand ends caps for a liner. Each end cap is formed with a U-shaped body portion 52 conforming to the cross-sectional shape of the trough and is similar in cross-section to the connector 36. The U-shaped body portion is formed with a recess 54 extending from front to rear of the cap along the transverse curved edge in order to receive the end of the liner which is inserted in the recess. Integral ribs 56 are provided to accommodate the liner ribs so that the end of the liner section will fit fully and snuggly to the end cap. A transverse end wall 58 is formed across the back of the body portion extending from top to bottom thereof and terminating along its upper edge, with an outwardly curved lip 60 which may be fastened, bonded or otherwise sealed to the end of the gutter to prevent the entry of rain water between the end cap and the gutter. The end caps may be molded from suitable plastic material and may be sealed to the ends of the liner by suitable adhesives, sealing agents, or the like, as described above.

Figure 4:
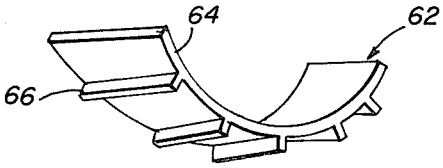
FIG. 4 is a view in perspective showing a lifter for use with the liner.

In the event that the gutter 14 does not have the proper pitch for drainage of water along the trough, a correct pitch can be introduced by installing lifters 62 between the liner and the gutter, as shown in FIGS. 4 and 5. The lifters may be spaced at different points along the gutter at the required locations in order to raise one end of the liner above the other end to produce the proper drainage pitch. The lifter, as shown in FIG. 4, is comprised of an arcuate body portion 64 which may be of molded plastic formed with a smooth upper surface and a plurality of spaced radially-protruding legs or ribs 66 along the bottom surface. The ribs 66 are relatively short and have a length sufficient to raise the lifter and the liner supported thereon enough to produce the desired pitch. If desired, the legs may be relatively long and may be trimmed off with a knife or scissors so that where a number of lifters are installed the height of each lifter may be gradually decreased to provide a gently sloping pitch to the liner from end-to-end of the gutter. If the liner material being used is particularly thin and flexible, the lifters would not be suitable since the liner would sag between adjacent lifters. In such a case, the liner may be raised by shims of flexible plastic strips placed under the liner, or by thin, stiff rods extended between lifters, or by a rigid elongated trough placed under the liner and raised at one end.

Referring now to FIG. 6 of the drawings, there is illustrated a modification of the invention and, in this embodiment, there is shown an end cap 68 similar in general shape to the end caps 24 and 26 with the exception that the U-shaped portion is relatively thin and formed without the recess of the principal embodiment, the device being solid throughout. The end cap 68 of FIG. 6 is used in conjunction with a connector 36 to form a joint with the liner 10. As shown, the connector 36, which is provided with recesses on both edges, connects at one edge to the edge of the end cap 68 and the other edge receiving the end of the liner, the parts being pressed together to provide a joint which may be sealed with adhesives, bonding agents, or the like.

Figure 7:
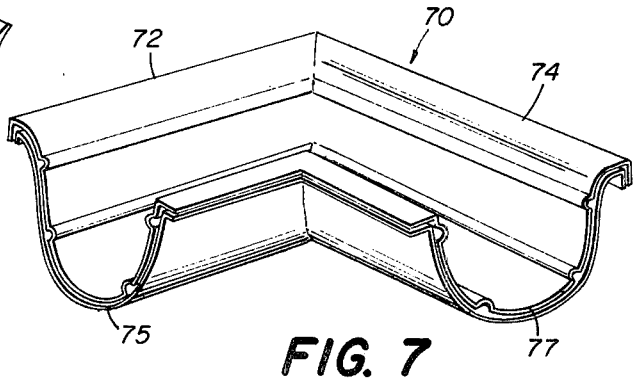
FIG. 7 is a view in perspective showing a corner liner piece.

Referring now to FIG. 7 of the drawings, there is illustrated an outside corner fitting 70 for use with the liner 10 to provide a continuous weatherproof gutter lining around the outside corner of a building. The fitting, which may be molded from plastic, is of a one-piece construction formed with a pair of legs 72 and 74 at right angles to one another, each formed with a trough-shaped cross-section, the ends of which may be formed with recesses 75 and 77 to accommodate the ends of the liner. Obviously, corner fittings may be provided in a number of different angles, as required, although the 90° outside angle illustrated would be the most common as would be a 90° inside angle corner fitting.

Figure 8:
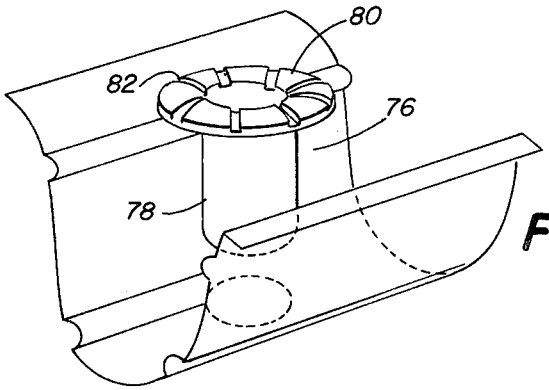
FIG. 8 is a view in perspective showing a drain tube fitting used with the invention.

Referring now to FIG. 8 of the drawings, there is illustrated a downspout connector 76 for use with the liner as a means for connecting the lined trough of the gutter to a pre-existing drain. The downspout connector 76, as shown, has a tubular base portion 78 which may be slightly tapered and is formed at its top with an annular flange 80 having a plurality of grooves or notches 82 formed radially thereabout. The function of the grooves is to provide ready, low level drain passages for water in the trough. The device is installed preferably by cutting a circular opening in the liner directly above the existing downspout opening in the gutter or by forming a cross slit and pressing the tubular base 78 down into the opening. Preferably, the device should be bonded to the liner and any one of a variety of sealants may be used for this purpose in order to produce a watertight seal between the flange 80 and the liner.

Figure 9:
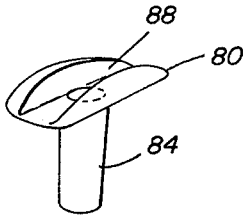
FIG. 9 is a view in perspective showing a modification of the drain tube.

Referring now to FIG. 9, there is illustrated a modification of the downspout connector, and in this embodiment a tubular base 84 is provided with a T-shaped head 86 having a diametrical groove 88 across the top. When installed, the groove 88 should be aligned with the length of the gutter so that all rain water will readily flow along the groove and into the downspout connector.

The liner system may be used on both new and old gutters, including those that may have started to rot, thereby extending the useful life of the gutter. The liner could also be used with metal or plastic gutters that have developed leaks for some reason such as corrosion, storm damage or the like.

While the invention has been described with particular reference to the illustrated embodiments, numerous modifications thereto will appear to those skilled in the art.

Having thus described the invention, what I claim and desire to obtain by Letters Patent of the United States is:

1. A system for weatherproofing the trough of a wooden gutter, comprising (a) an elongated, waterproof, longitudinally and laterally flexible, soft plastic liner adapted to line the surface of the gutter trough when installed therein, said liner being characterized by a softness and flexibility sufficient for said liner to conform to the contour of said trough when installed therein, and (b) end caps connectable to the ends of said liner to close the ends thereof, (c) the lower surface of said liner being formed with longitudinal corrugations.

2. A system, according to claim 1, wherein said liner is generally U-shaped in cross-section and formed with longitudinal lips along both long edges thereof.

3. A system, according to claim 2, wherein said liner is formed with integral spaced parallel ribs along the upper surface thereof.

4. A system, according to claim 1, including at least one connector for joining with other components of said system in end-to-end relation, said connector being generally U-shaped in cross-section and formed with a groove along the side edges thereof.

5. A system, according to claim 1, including a corner piece for joining liner sections at an angle, said corner piece being formed with a pair of angularly disposed legs each of U-shaped cross-section and adapted to fit in the corner of the trough of two gutters joined at an angle.

6. A system, according to claim 1, including a drain connector comprised of a tubular lower portion and a flanged upper portion, said upper portion being formed with at least one groove between the edge of the flanged portion and the top of said tubular portion.

7. A system, according to claim 1, wherein said liner is longitudinally and laterally flexible to an extent sufficient to allow a length of said liner to be rolled into a coil, said liner being formed with a normally U-shaped cross-section when in a relaxed, straight condition.

8. A system, according to claim 7, wherein said liner is formed with a plurality of spaced parallel ribs lengthwise along the upper surface thereof, the bottom surface being smooth.

9. A system, according to claim 7, wherein said liner is formed with outwardly extending flanges along both long edges thereof.

10. A system, according to claim 7, wherein said liner is of a thickness between 0.010" to ⅛".

11. A liner for weatherproofing the trough of a gutter, comprising (a) a section of waterproof, flexible resilient, soft plastic material of a width and length sufficient to cover the surface of said trough in surface-to-surface contact therewith, (b) said liner being generally U-shaped in cross-section in a relaxed, straight condition and being sufficiently flexible to be rolled into a generally flat coil, (c) the face of said liner adapted to contact the surface of said trough being formed with longitudinal corrugations.

12. A system for weatherproofing the trough of a wooden gutter, comprising (a) an elongated , waterproof, flexible plastic liner adapted to line the surface of a gutter trough when installed therein, (b) end caps connectable to the ends of said liner to close the ends thereof, and, (c) at least one lifter adapted to be mounted between the liner and the trough to raise the height of said liner, said lifter being in the form of an arcuate section conforming to the curve of the trough.

13. A liner for weatherproofing the trough of a wooden gutter, comprising (a) a section of waterproof, flexible, resilient, soft plastic material of a width and length sufficient to cover the surface of said trough in surface-to-surface contact therewith, (b) said liner being generally U-shaped in cross-section in a relaxed straight condition and being sufficient flexible to be rolled into a generally flat coil, (c) the face of said liner adapted to contact the surface of said trough being formed with a plurality of parallel longitudinal grooves and ribs.

14. A liner according to claim 13 in combination with a generally rigid, U-shaped, pre-formed and relatively short member dimensioned to fit in said trough and to connect with an end of said liner.

* * * * *